US010122069B2

(12) United States Patent
Ghit et al.

(10) Patent No.: US 10,122,069 B2
(45) Date of Patent: Nov. 6, 2018

(54) MOBILE TERMINAL DEVICE

(71) Applicants: Chan Yun Ghit, Shenzhen (CN); Ng Guan Hong, Shenzhen (CN); Tay Yew Siow, Shenzhen (CN)

(72) Inventors: Chan Yun Ghit, Shenzhen (CN); Ng Guan Hong, Shenzhen (CN); Tay Yew Siow, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 514 days.

(21) Appl. No.: 15/062,100

(22) Filed: Mar. 5, 2016

(65) Prior Publication Data

US 2017/0033438 A1 Feb. 2, 2017

(30) Foreign Application Priority Data

Jul. 31, 2015 (CN) ..... 2015 1 0465475

(51) Int. Cl.
*H01Q 1/24* (2006.01)
*H01Q 9/04* (2006.01)
*H01Q 5/30* (2015.01)

(52) U.S. Cl.
CPC ..... *H01Q 1/243* (2013.01); *H01Q 5/30* (2015.01); *H01Q 9/0421* (2013.01)

(58) Field of Classification Search
CPC ..... H01Q 1/243; H01Q 5/30; H01Q 9/0421
See application file for complete search history.

(56) References Cited

U.S. PATENT DOCUMENTS

2009/0315789 A1* 12/2009 Sung ..... H01Q 1/243 343/702
2014/0300518 A1* 10/2014 Ramachandran ..... H01Q 1/243 343/702

* cited by examiner

*Primary Examiner* — Dameon E Levi
*Assistant Examiner* — David Lotter
(74) *Attorney, Agent, or Firm* — Na Xu; IPro, PLLC

(57) ABSTRACT

A mobile terminal device is provided in the present disclosure. The mobile terminal device includes a metal back cover with a groove, a printed circuit board with a groove opening corresponding to the groove, and an antenna module. The antenna module includes a radiator body and a groove adaptor member, at least part of the metal back cover serves as the radiator body of the antenna module. The groove adaptor member includes a groove adapting part and a supporting part for supporting the groove adapting part, the groove adapting part includes a main body, a first extending piece and a second extending piece. The main body is received in the groove opening and aligned with the groove; the first extending piece and the second extending piece respectively extend from two opposite edges of the main body and are connected to the printed circuit board.

16 Claims, 7 Drawing Sheets

MOBILE TERMINAL DEVICE

FIELD OF THE DISCLOSURE

The present disclosure generally relates to mobile communication technologies, and more particularly, to a mobile terminal device with a dual-band frequency antenna.

BACKGROUND

With development of mobile communication technologies, mobile terminal devices such as mobile phones are used more and more widely. Mobile terminal devices normally use antenna modules to convert electric power into radio waves, and vice versa, for realizing wireless transmission and reception.

A planar inverted-F antenna (PIFA) is a typical antenna module used in the mobile terminal device; the PIFA includes a planar radiating unit serving as a radiator, and a ground plate with a large area serving as a reflector. The PIFA is installed in the mobile terminal device and the ground plate is connected to a system ground of a main board of the mobile terminal device.

The PIFA is a kind of built-in antennas which is needed to receive in a plastic shell or frame of mobile terminal device. However, mobile terminal devices with metal frames are preferred by people because of their fashion appearance as well as good durability, the metal frame may bring an electromagnetic shielding effect to the antenna module of the mobile terminal device, and therefore an antenna performance of the mobile terminal device is low.

Therefore, it is desired to provide a new mobile terminal device which can overcome the aforesaid problems.

BRIEF DESCRIPTION OF THE DRAWINGS

Many aspects of the embodiment can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
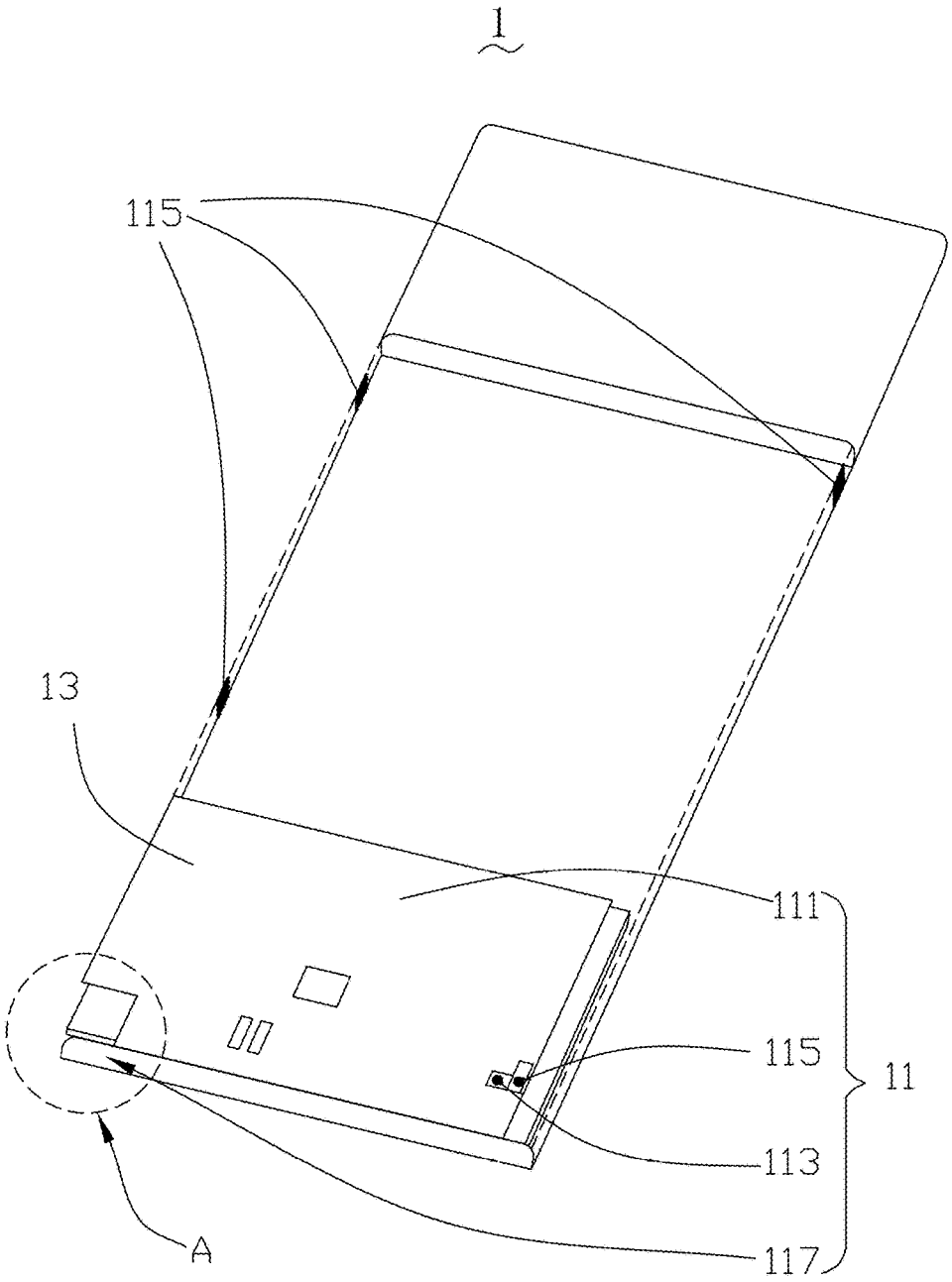
FIG. 1 is a schematic view of a mobile terminal device with a dual-band antenna module according to an embodiment of the present disclosure.

The present disclosure will be described in detail below with reference to the attached drawings and the embodiment thereof.

Referring to FIGS. 1-4, a mobile terminal device 1 with a dual-band antenna module according to an embodiment of the present disclosure is shown. The mobile terminal device 1 may be a mobile phone with a full metal cover. Specifically, the mobile terminal device 1 includes a dual-band antenna module 11, a display module 12, a metal back cover 13 and a printed circuit board 15. The display module 12 may be a liquid crystal display (LCD) module, and the printed circuit board 15 is located on a rear surface of the display module 12. The metal back cover 13 covers the printed circuit board 15, the display module 12 and the dual-band antenna module 11.

The metal back cover 13 includes a groove 130, the groove 130 may be an elongated plastic groove 130 recessed from an edge of the metal back cover 130. The printed circuit board 15 includes a groove opening 151 aligned with and corresponding to the groove 130 of the metal back cover 13.

The dual-band antenna module 11 may operate in two available frequency bands, e.g., a first frequency band from 2400 MHz to 2500 MHz and a second frequency band from 5150 MHz to 5180 MHz. The dual-band antenna module 11 includes a radiator body 111, a feed point 113, a ground point 115 and a groove adaptor member 117. In the present embodiment, the entire metal back cover 13 or part of the metal back cover 13 may serve as the radiator body 111 of the dual-band antenna module 11, and moreover, the radiator body 111 may extend to a periphery of the display module 12.

The feed point 113 and the ground point 115 of the dual-band antenna module 11 may be formed on the printed circuit board 15, and moreover, the dual-band antenna module 11 may further includes other ground points 115 formed at the metal back cover 13 or at two opposite sidewalls of the mobile terminal device 1.

Figure 2:
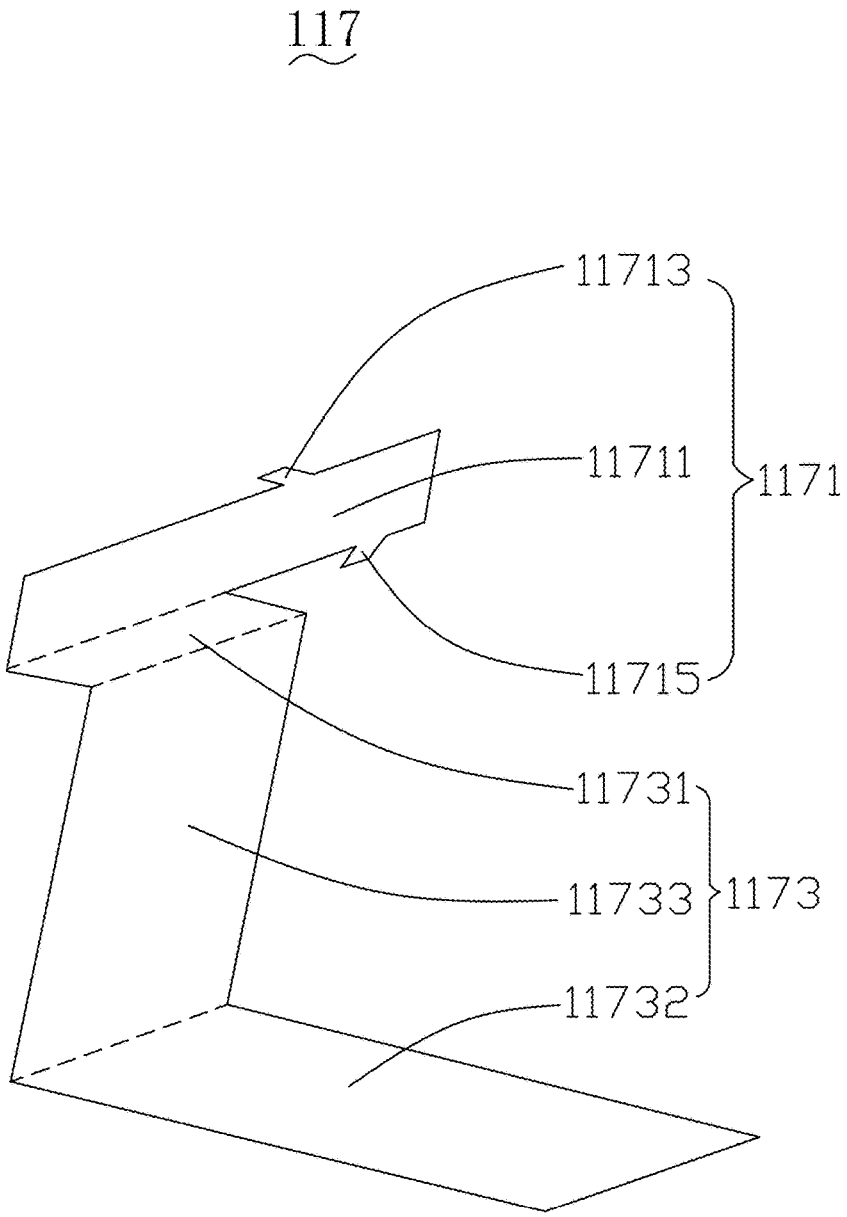
FIG. 2 is a schematic view of a groove adapter member of the dual-band antenna module of the mobile terminal device of FIG. 1.

As illustrated in FIG. 2, the groove adaptor member 117 of the dual-band antenna module 11 includes a groove adapting part 1171 and a supporting part 1173 for supporting the groove adapting part 1171. The groove adapting part 1171 includes a main body 11711, a first extending piece 11713 and a second extending piece 11715. The main body 11711 may be located in the groove opening 151 and is aligned with the groove 130 of the metal back over 13. The first extending piece 11713 extends perpendicularly from an upper edge of the main body 11711, and may serve as a first pin connected to a top surface of the printed circuit board 15. The second extending piece 11715 extends perpendicularly from a lower edge of the main body 11711, and may serve as a second pin attached to a bottom surface of the printed circuit board 11711.

In particular, the first extending piece 11713 may be electrically connected to the feed point 113 on the printed circuit board 15, and is connected to the radiator body 111 of the dual-band antenna module 111 via the top surface of the printed circuit board 15. The second extending piece 11713 may be electrically connected to the ground point 115 on the printed circuit board 15, and is connected to the radiator body 111 of the dual-band antenna module 111 via the bottom surface of the printed circuit board 15. In addition, the main body 11711 may be perpendicular to the display module 12, and plastic filler may be filled in the groove 130 of the metal back cover 13 to fix the main body 11711 in the groove opening 151. The plastic filler may be acrylonitrile butadiene styrene (ABS) resin or polycarbonate acrylonitrile butadiene styrene (PC-ABS) resin.

The supporting part 1173 may have an orthogonal zigzagged configuration in cross-section, which includes an extending plate 11731, a connecting plate 11733 and a fixing plate 11732. The extending plate 11731 is connected to the lower edge of the main body 11711, for example, the extending plate 11731 may extend perpendicularly from the lower edge of the main body 11711 along a direction opposite to the second extending piece 11715. The fixing plate 11732 extends opposite to the extending plate 11731 and may further be attached to the display module 12. The connecting plate 11733 is perpendicularly connected between the extending plate 11731 and the fixing plate 11732. In particular, the extending plate 11731 may be located at the groove opening 151 and face the groove 130 of the metal back cover 13.

Figure 3:
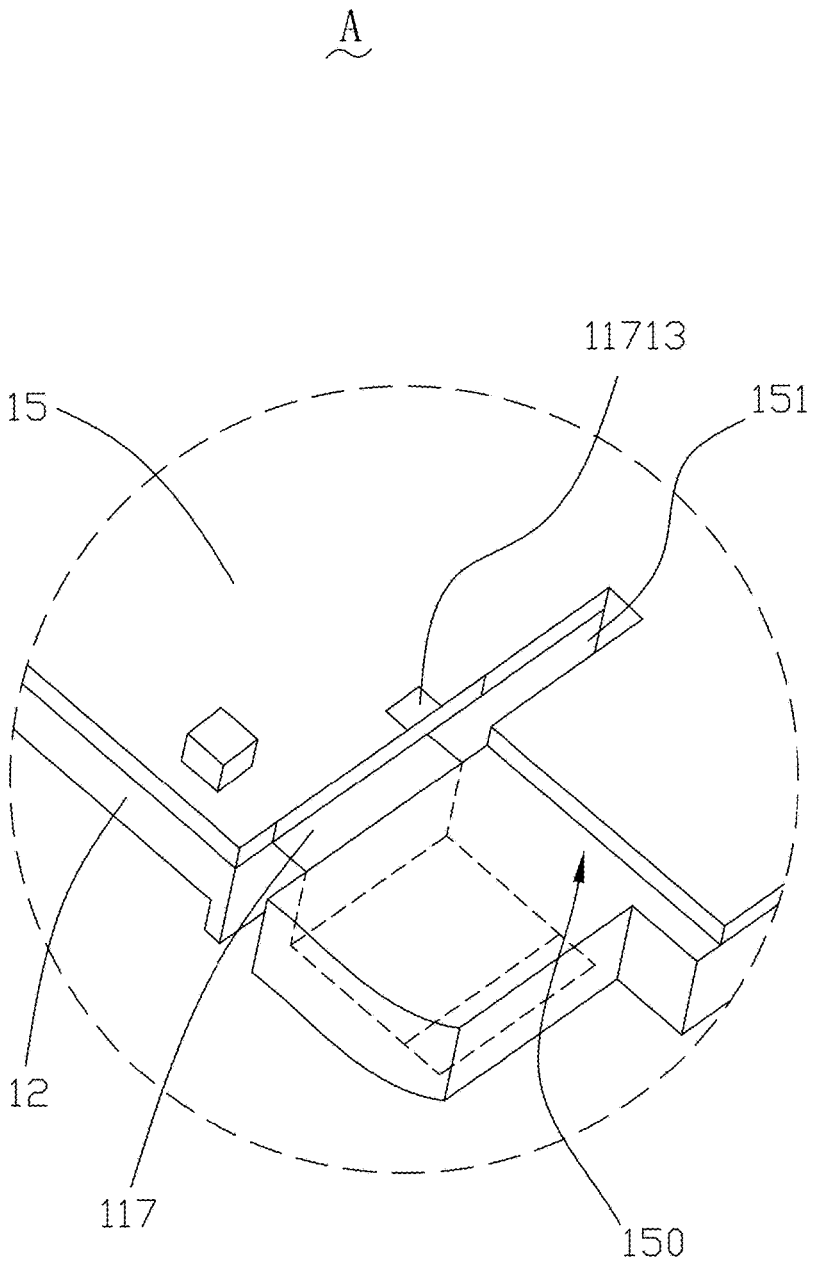
FIG. 3 is an enlarged view of part A of the mobile terminal device of FIG. 1.
Figure 4:
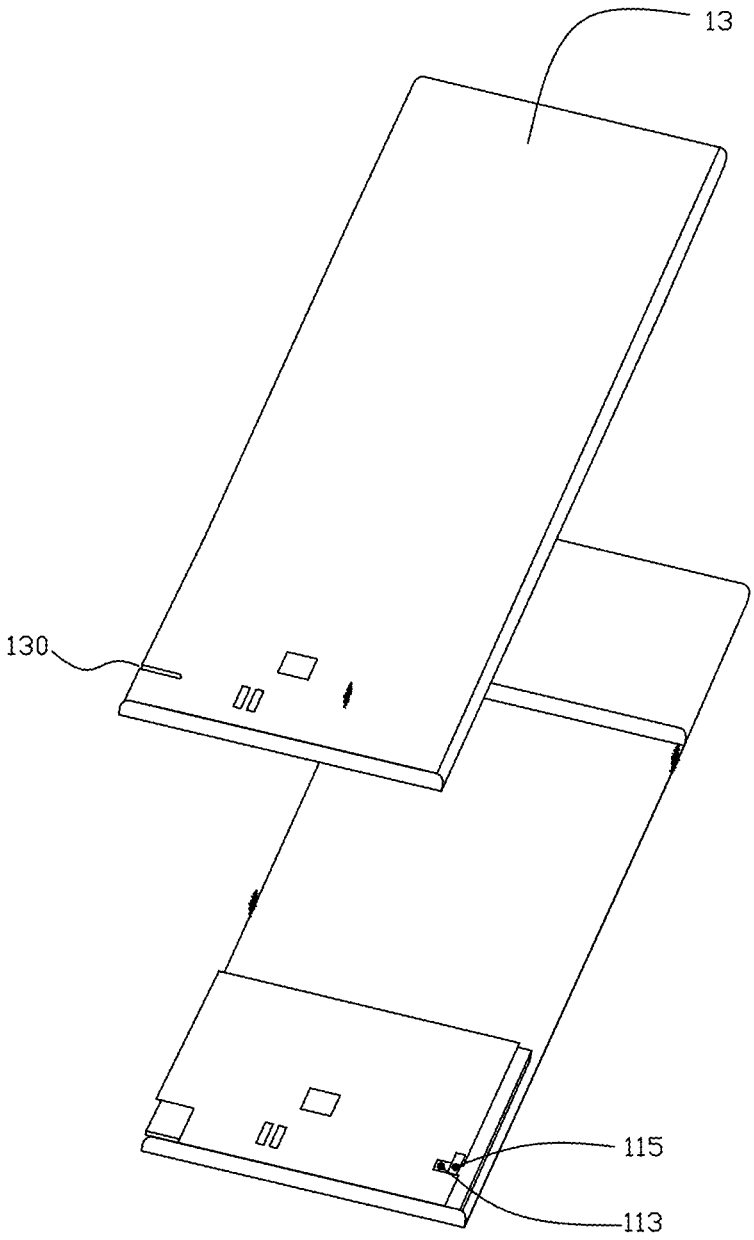
FIG. 4 is an exploded view of the mobile terminal device of FIG. 1.

In the present embodiment, the printed circuit board 15 may either be a single layer circuit board or a multi-layer circuit board. When the printed circuit board 15 is a multi-layer circuit board, the first extending piece 11713 and the second extending piece 11715 may be connected to two different circuit layer of the printed circuit board 15. Preferably, the printed circuit board 15 includes an upper circuit layer and a lower circuit layer, and the first extending piece 11713 and the second extending piece 11715 are connected to the upper circuit layer and the lower circuit layer respectively. Furthermore, as illustrated in FIG. 3, the printed circuit board 15 may further include a grounding gap 150 extending from the groove opening 151, and an extension length of the grounding gap 150 may for example be 7 mm.

Figure 5:
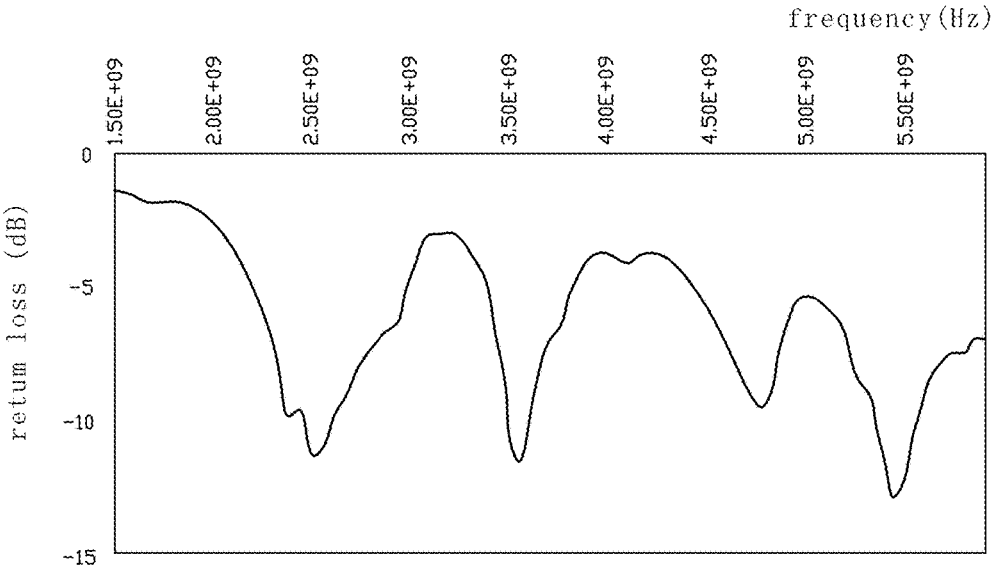
FIG. 5 is a return loss diagram of the dual-band antenna module of the mobile terminal device of FIG. 1.
Figure 6:
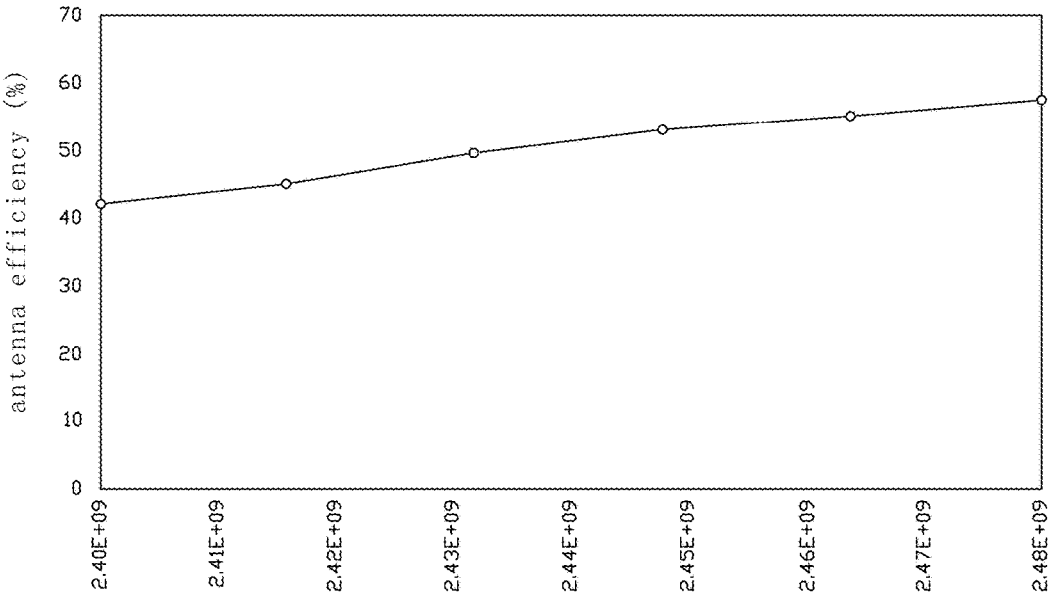
FIG. 6 is an antenna efficiency diagram of the dual-band antenna module of the mobile terminal device of FIG. 1 when operating in a first frequency band of 2400 MHz-2500 MHz.
Figure 7:
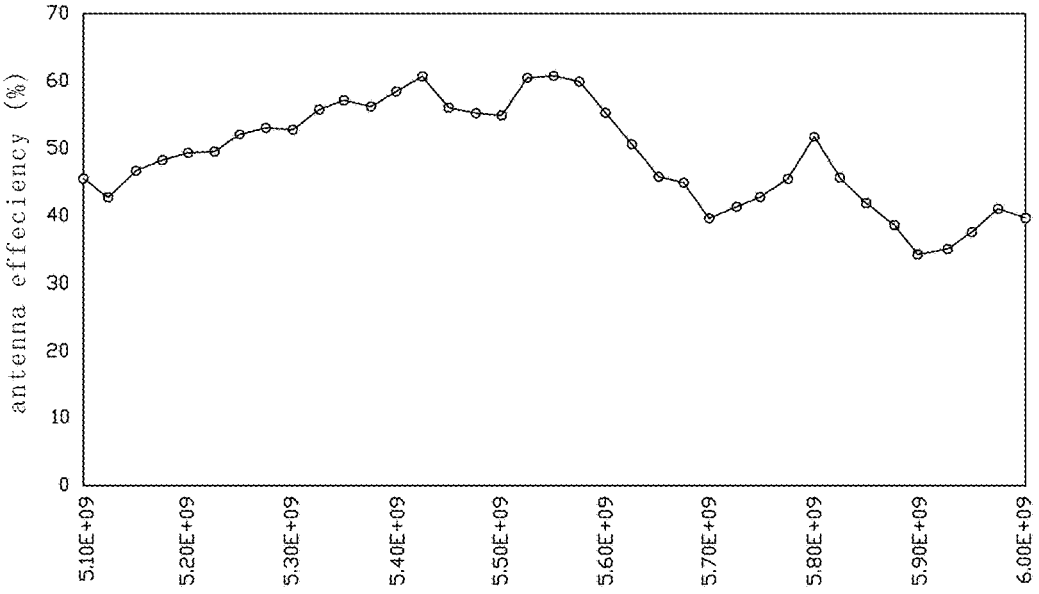
FIG. 7 is an antenna efficiency diagram of the dual-band antenna module of the mobile terminal device of FIG. 1 when operating in a second frequency band of 5150 MHz-5180 MHz.

Referring to FIGS. 5-7, a return loss diagram and antenna efficiency diagrams corresponding to the two frequency bands are shown. As can be seen from the antenna efficiency diagrams, the dual-band antenna module 11 of the mobile terminal device 1 can obtain an antenna efficiency greater than 40% in the first frequency band from 2400 MHz to 2500 MHz, and can also obtain an antenna efficiency greater than 35% in the second frequency band from 5150 MHz to 5180 MHz. In other words, the dual-band antenna module 11 of the mobile terminal device 1 has good antenna efficiency in both of the two frequency bands, and thus the mobile terminal device 1 can operate in two different frequency bands and has a wider frequency coverage.

In the mobile terminal device 1 as provided in the present disclosure, the dual-band antenna module 11 includes a groove adaptor member 117 with a groove adapting portion 1171 aligned with the groove 130 of the metal back cover 13, the groove adaptor member 117 can enable the metal back cover 13 to realize great antenna radiation, and thus an antenna performance of the mobile terminal device 1 can be improved. Besides, the groove 130 is filled with plastic filler, which can increase impact resistance, heat resistance, and low temperature resistance of the dual-band antenna module 11.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A mobile terminal device, comprising:

a metal back cover comprising a groove;

a printed circuit board comprising a groove opening corresponding to the groove of the metal back cover; and an antenna module comprising a radiator body and a groove adaptor member;

wherein at least part of the metal back cover serves as the radiator body of the antenna module, and the groove adaptor member comprises a groove adapting part and a supporting part for supporting the groove adapting part, the groove adapting part comprises a main body, a first extending piece and a second extending piece; the main body is received in the groove opening of the printed circuit board and aligned with the groove of the metal back cover, the first extending piece and the second extending piece respectively extend from two opposite edges of the main body and are connected to the printed circuit board.

2. The mobile terminal device of claim 1, wherein the groove is an elongated groove recessed from an edge of the metal back cover.

3. The mobile terminal device of claim 2, wherein the groove is filled with plastic filler, and the main body of groove adapting part is fixed in the groove opening by the plastic filler.

4. The mobile terminal device of claim 3, wherein the plastic filler is made of acrylonitrile butadiene styrene (ABS) resin or polycarbonate acrylonitrile butadiene styrene (PC-ABS) resin.

5. The mobile terminal device of claim 1, wherein the antenna module is a dual-band antenna module.

6. The mobile terminal device of claim 5, wherein the antenna module have a first frequency band from 2400 MHz to 2500 MHz and a second frequency band from 5150 MHz to 5180 MHz.

7. The mobile terminal device of claim 5, wherein the antenna module further comprises a feed point and a ground point, the first extending piece serves as a first pin and is electrically connected to the feed point via the printed circuit board; the second extending piece serves as a second pin and is electrically connected to the ground point via the printed circuit board.

8. The mobile terminal device of claim 7, wherein the first extending piece is connected to the radiator body via a top surface of the printed circuit board, and the second extending piece is connected to the radiator body via a bottom surface of the printed circuit board.

9. The mobile terminal device of claim 1, further comprising a display module, wherein the printed circuit board is located on the display module.

10. The mobile terminal device of claim 9, wherein the radiator body extends to a periphery of the display module.

11. The mobile terminal device of claim 10, wherein the antenna module further comprises a plurality of ground points formed at the metal back cover or at two opposite sidewalls of the mobile terminal device.

12. The mobile terminal device of claim 9, wherein the supporting part comprises an extending plate perpendicularly extending from the main body along a direction opposite to the second extending piece, a fixing plate attached to the display module, and a connecting plate connected between the extending plate and the fixing plate.

13. The mobile terminal device of claim 12, wherein the supporting part may has an orthogonal zigzagged configuration in cross-section.

14. The mobile terminal device of claim 1, wherein the printed circuit board further comprises a grounding gap extending from the groove opening.

15. The mobile terminal device of claim 14, wherein the printed circuit board is a single layer printed circuit board, and the first extending piece and the second extending piece are respectively connected to a top surface and a bottom surface of the printed circuit board.

16. The mobile terminal device of claim 14, wherein the printed circuit board is a multi-layer printed circuit board, and the first extending piece and the second extending piece are respectively connected to two different circuit layer of the printed circuit board.

* * * * *